US007824062B2

(12) United States Patent
Ho

(10) Patent No.: US 7,824,062 B2
(45) Date of Patent: Nov. 2, 2010

(54) ILLUMINATING DEVICE WITH OPTICAL ELEMENT

(76) Inventor: Yen-Wei Ho, P.O. Box 215, Taichung (TW) 40099

( * ) Notice: Subject to any disclaimer, the term of this patent is extended or adjusted under 35 U.S.C. 154(b) by 176 days.

(21) Appl. No.: 12/230,643

(22) Filed: Sep. 3, 2008

(65) Prior Publication Data

US 2010/0002422 A1 Jan. 7, 2010

(30) Foreign Application Priority Data

Jul. 1, 2008 (TW) ..... 97211659 U

(51) Int. Cl.
*F21L 4/00* (2006.01)

(52) U.S. Cl. ..... 362/188; 362/270; 362/277

(58) Field of Classification Search ..... 362/187, 362/188, 269, 270, 277, 279, 285
See application file for complete search history.

(56) References Cited

U.S. PATENT DOCUMENTS 1,082,887 A * 12/1913 Maisel ..... 362/204
5,014,171 A * 5/1991 Price, III ..... 362/277
5,588,739 A * 12/1996 Nakao ..... 362/205
6,598,993 B1 * 7/2003 Dalton et al. ..... 362/202
7,360,920 B2 * 4/2008 Dalton et al. ..... 362/187
7,473,007 B1 * 1/2009 Wang ..... 362/187

* cited by examiner

*Primary Examiner*—Gunyoung T Lee

(57) ABSTRACT

An illuminative device, offers an optical device that is regulated by one hand and a LED circuit board that is sealed in waterproof and quick cooling structure. The illuminator, comprises a main body included a tube container for at least a battery and a narrow tube in the front end, a switch device set in rear end of the main body, which includes a battery cover, a screw thread portion for screwing to the main body, a switch board that sets a trigger on one end and a spring pole on the other end for a connection to the battery, and a elastic switch button that sets on the switch board, an emitting device included a LED circuit board and a tube base as a radiator, and a optical device included a sleeve with an inside circular stop flange at the rear end and an inside screw thread at the front end, a lens that holds at the front end of the sleeve, and a fastening ring with an outside screw thread for fixing the lens into the sleeve.

In according assembly, the illuminative device can switch on/off the power by the switch device at the rear end, and regulates the optical device by one hand to project from a narrow to a wide light spot.

9 Claims, 4 Drawing Sheets

ILLUMINATING DEVICE WITH OPTICAL ELEMENT

FIELD OF THE INVENTION

The present invention generally relates to the field of illuminative devices and more specifically to torches and lamps, and the mechanical methods of the LED with an optical device to project a zoom-able range of included angles of the light beams.

BACKGROUND OF THE INVENTION

In the field of torches and lamps, LED has been used as the light emitter for less electricity and high illuminative performance. A torch usually set a lens in front of a LED to focus the light beam in a narrow included angle for an enhance light spot. In the prior art, the lens was movable in forward-backward to the light emitter for casting the light beam to shine a zoom-able spot. The mechanical method of changing distance of the focus distance of a lens usually set the lens on a sleeve with a screwing thread and screwed the sleeve to main body of the torch. By the screwing the sleeve, the distance between the lens and the led would be changed. Therefore, each time the regulation of zoom in or out of the light spot needed to use both hand to screw the sleeve out or in.

In prior art, a LED circuit board was set by an elastic element to against and holding on front of the main body. As the elastic element fatiguing, the conduction of the circuit board and the batteries would fail. The material of the torch with bed cooling efficiency of the main body caused the LED circuit board too hot and shortened the life of LED.

Accordingly, in view of the foregoing, there is currently a need in the art for improving devices on the regulation of the focus distance of the lens for casting a zoom-able spot by one hand, and the methods of sealing LED circuit board.

SUMMARY OF THE INVENTION

The present invention, which is an illuminative device, offers an optical device that is regulated by one hand to zoom the light beam and a LED circuit board that is sealed in waterproof and quick cooling structure.

Accordingly, the present invention, which is an illuminator, comprises:

a main body included a tube container for at least a battery and a narrow tube in the front end;

a switch device set in rear end of the main body, which includes a battery cover, a screw thread portion for screwing to the main body, a switch board that sets a trigger on one end and a spring pole on the other end for a connection to the battery, and a elastic switch button that sets on the switch board, an emitting device included a LED circuit board and a tube base as a radiator, and an optical device included a sleeve with an inside circular stop flange at the rear end and an inside screw thread at the front end, a lens that holds at the front end of the sleeve, and a fastening ring with an outside screw thread for fixing the lens into the sleeve.

In according assembly, the illuminative device can switch on/off the power by the switch device at the rear end, and regulates the optical device to project a narrow or wide light spot by one hand.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
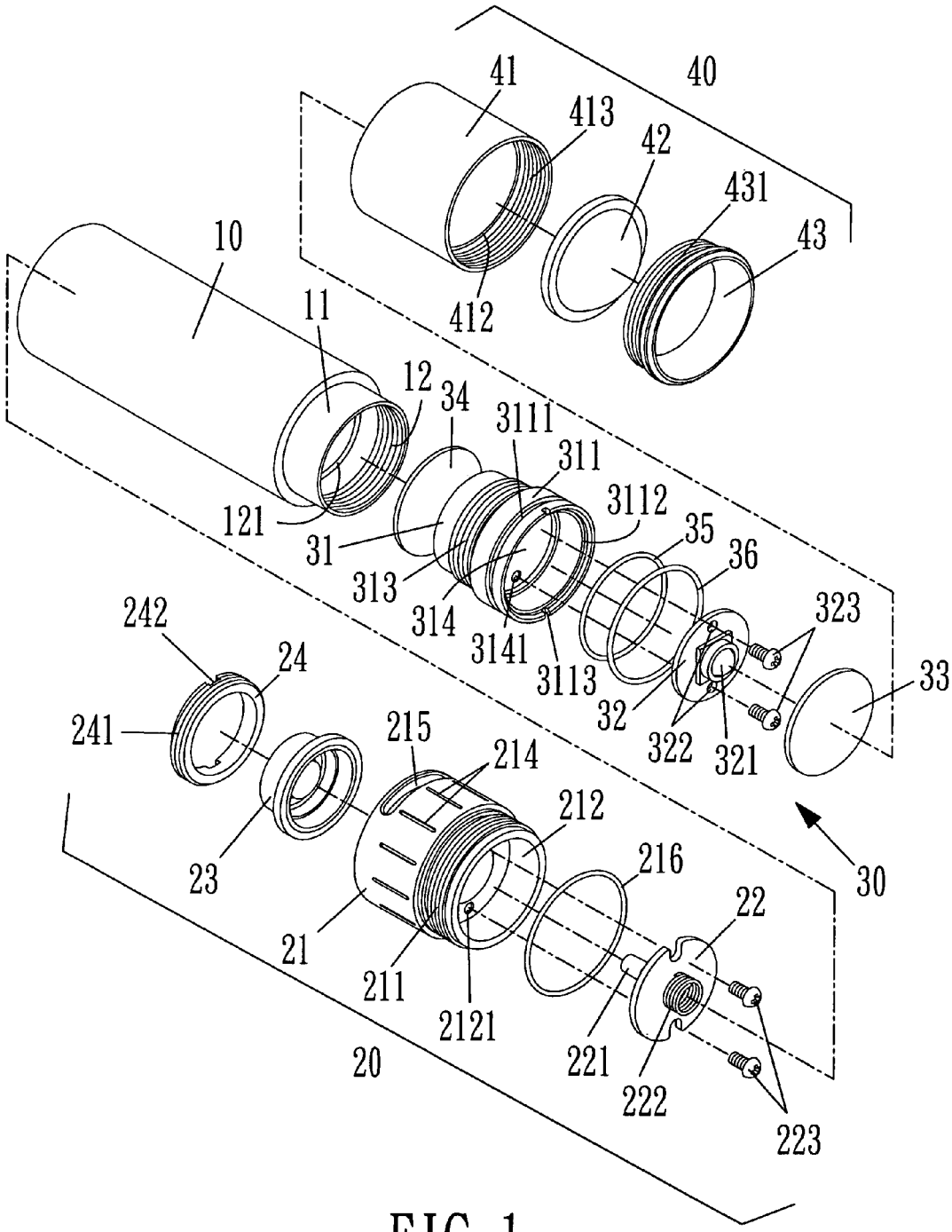
FIG. 1 is an exploded view of the preferred embodiment of the present invention for an illuminative device.
Figure 2:
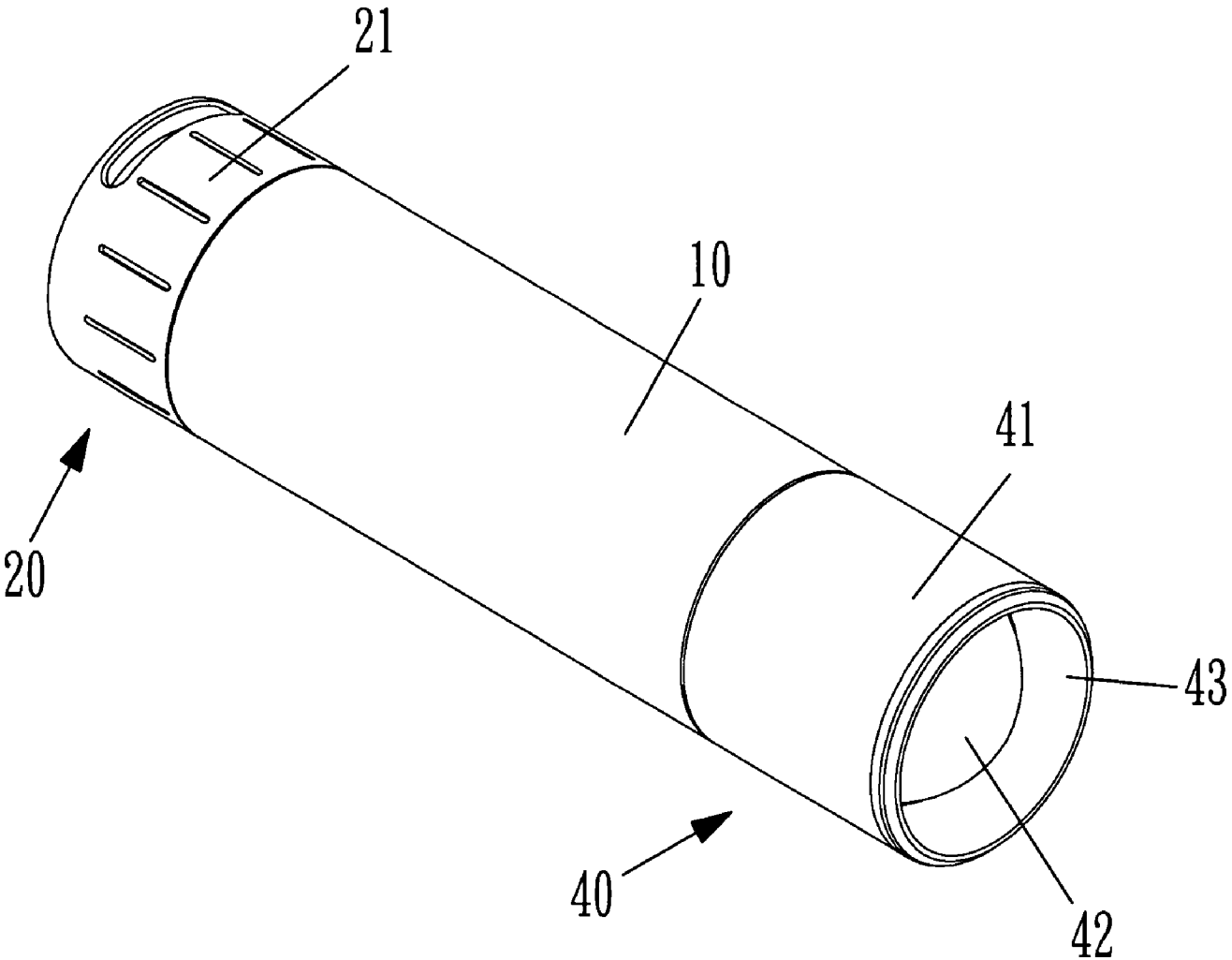
FIG. 2 is a projective view of the assembly of FIG. 1.
Figure 3:
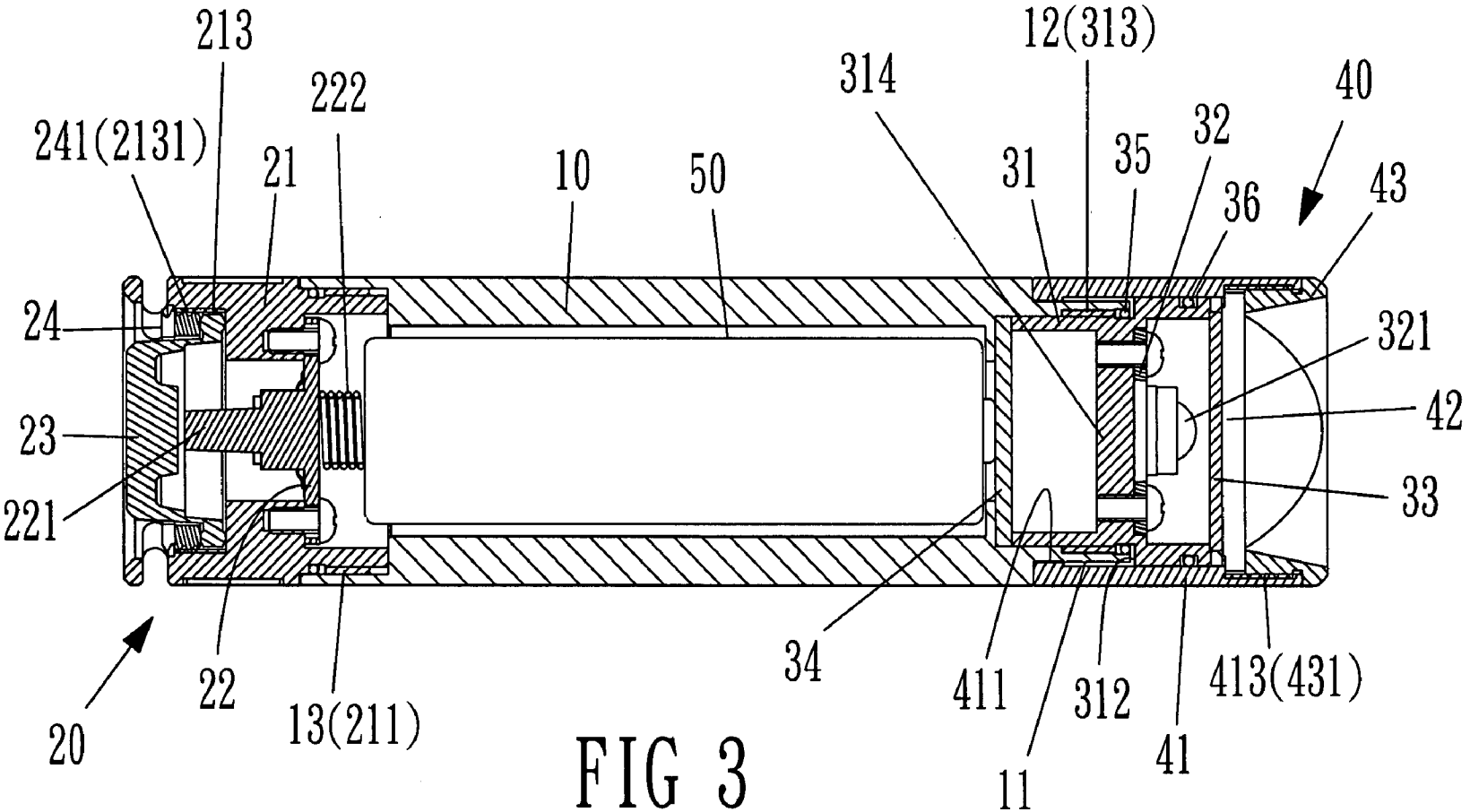
FIG. 3 is a cross sectional view of FIG. 2 as the optical device in the first position.
Figure 4:
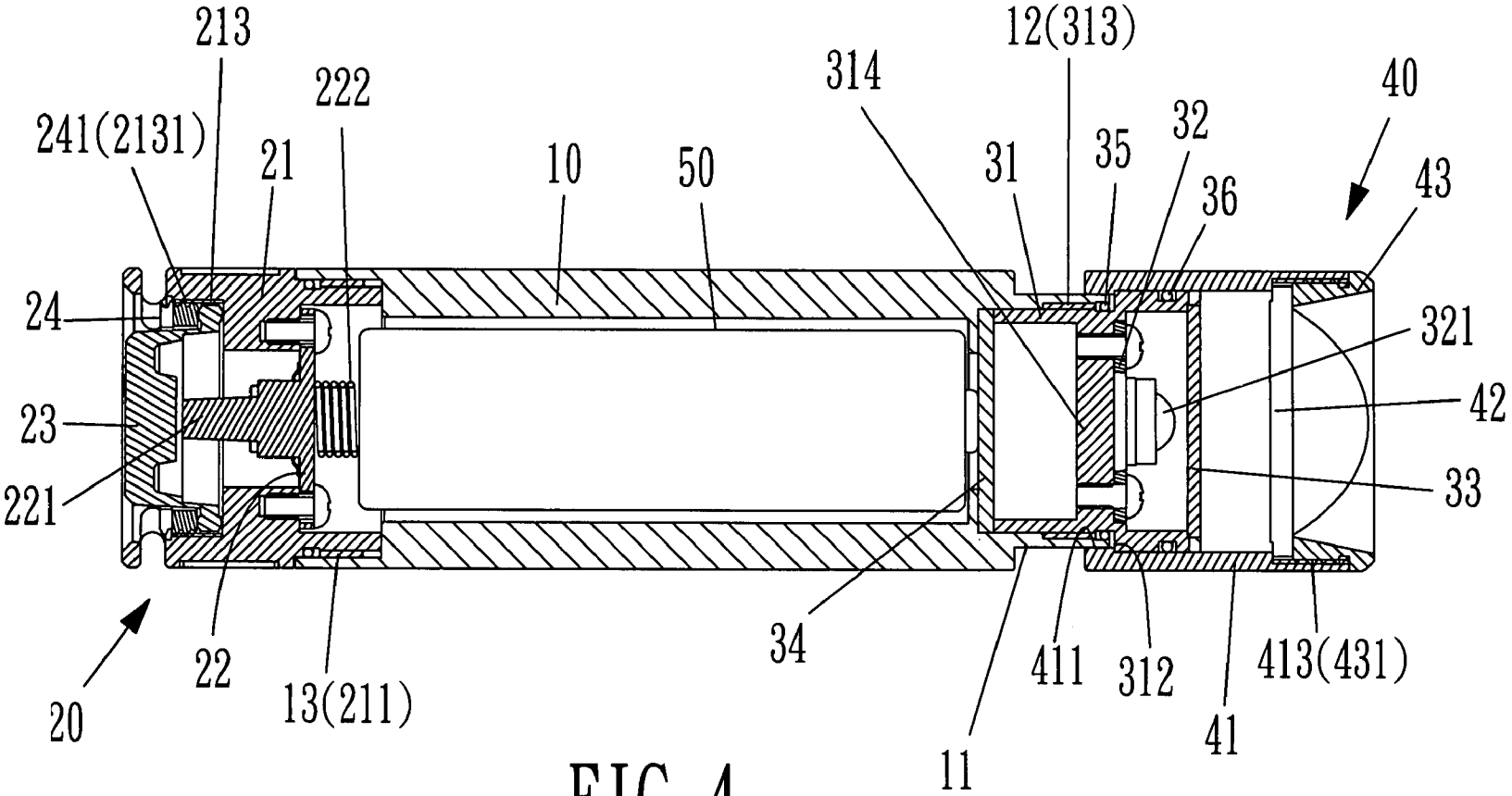
FIG. 4 is a cross sectional view of FIG. 2 as the optical device in the second position.

In the FIGS. 1 to 4, the preferred embodiment of the present invention comprises a main body 10, a switch device 20 at rear end of the main body 10, an emitting device 30 at front end of the main body 10, and an optical device 40 jointed onto the front end of the min body 10.

The main body 10 is a tube container for at least a battery 50, which is a narrow tube 11 with a front inside screw thread 12 at the front end and a rear inside screw thread 13 at the rear end.

The switch device 20 comprises a battery cover 21 that sets a front outside screw thread 211 for screwing to the rear inside screw thread 13 of the main body 10 and a front trough 212 with a pair of inside screw holes 2121 and a rear trough 213 with a inside screw thread 2131, a switch board 22 that sets a trigger 221 on one side to insert into the rear trough 213 and a spring pole 222 on the other side to contact with a pole of the battery 50 and two screws 223 fastening the switch board 22 on the inside screw holes 2121 of the front trough 212, a elastic switch button 23 that places on the trigger 221 and inserts into the rear trough 213, and a fastening ring 24 with an outside screw thread 241 to screw into the inside screw thread 2131 for fastening the elastic switch button 23.

The emitting device 30, which is a waterproof and heat conductive structure, comprises an emitter board 32 that sets an emitter 321 on the center and two fixing holes 322, a tube base 31 that includes a front tube section 311 with a circular flange 312, and a rear outside screw thread 313 for connecting with the front inside screw thread 12 of the main body 10 and a partition 314 that creates a front and a rear cooling spaces in the middle section with two screw holes 3141 for the emitter board 32 to fix on by two screws 323, a flat lens 33 to seal on the front open end of the tube base 31 for the front end waterproof of the emitter board 32, a sealing board 34 to seal on the rear open end of the tube base 31 for the rear end waterproof of the emitter board 32 and to against on a inside flange 121 of the main body 10, a first sealing ring 35 that sets between the sealing board 34 and the inside flange 121 of the main body 10, a second sealing ring 36 on a ring trough 3111 of the front tube section 311. The emitter 321 is a LED.

The optical device 40 included a sleeve 41 with an inside circular stop flange 411 at the rear end for shifting on the narrow tube 11 of the main body 10 and an inside screw thread 413 with a inside flange 412 at the front end, a lens 42 that holds at the inside flange 412 of the sleeve 41, and a fastening ring 43 with an outside screw thread 431 for the lens 42 to fasten into the inside screw thread 413 and to fix at the inside flange 412. The lens 42 is a convex flat lens with an aspheric surface of the convex end, which can project the optimum wide and narrow light spot as regulating the optical device 40.

In according assembly, a user can switch on/off the power of the emitting device 30 by pushing the switch device 20 at the rear end, and regulate the optical device 40 shifting on the narrow tube 11 of the main body 10 by one hand for changing the distance from the emitter 321 to the lens 42 to project a narrow or wide light spot.

The further details of the switch device 20 include the outside of battery cover 21 set many trough lines 214 that are for decoration and increasing the surface resistance as open the battery cover 21, a semi circular trough 215 that is convenient for the tool assembling at the rear end of the battery cover 21, a sealing ring 216 placed between the front outside screw thread 211 of the battery cover 21 and the rear inside screw thread 13 of the main body 10, and two troughs 242 set on the rear end of the fastening ring 24 for a tool to screw the fastening ring 24 into the inside screw trough 2131 of the rear trough 213 of the battery cover 21.

The further details of the emitting device 30 include the circular flange 312 where the outside diameter is slightly larger than the diameter of the narrow tube 11 for stop the inside circular stop flange 411 of the sleeve 41 as the sleeve 41 pushing out, a circular trough 3112 set on the front tube section 311 of the tube base 31 for the flat lens 33 to hold in, two trough 3113 for a tool to screw the tube base 31 into the main body 10, the flat lens 33 sealed or glued with the circular trough 3112, and two holes 322 of the emitter board 32 for two screws 323 to fix the emitter board 32 on the partition 314 of the tube base 31.

It will be appreciated by persons skilled in the art that the present invention is not limited to what has been particularly shown and described herein, and that the drawings are not necessarily to scale. A variety of modifications and variations are possible in light of the above teachings without departing from the scope and spirit of the invention, which is limited only by the following claims.

What is claimed is:

1. An illuminative device comprising:

a main body that includes a tube container for at least a battery and a narrow tube at the front;

an emitting device that includes a tube base with a front tube section where an outside diameter of the front tube is larger than an outside diameter of the narrow tube for a stopping flange, a partition at the middle section, an emitter board set an emitter on the center and fixed on the partition, and a flat lens sealed on a front open end of the tube base;

an optical device that includes a sleeve where a rear end shifts on the narrow tube of the main body and an inside circular stop flange of the sleeve for stop the sleeve to push out, a lens that sets into an inside of the front end of the sleeve, and a fastening ring for fastening the lens into the sleeve.

2. An illuminative device in accordance with claim 1, wherein the main body sets a front inside screw thread to screw onto a rear outside screw thread of the tube base.

3. An illuminative device in accordance with claim 1, wherein the rear open end sets a board for sealing and conducting the electric power to the emitter board.

4. An illuminative device in accordance with claim 1, wherein the tube base and the narrow tube of the main body sets a first sealing ring in between.

5. An illuminative device in accordance with claim 1, wherein the front tube section of the tube base sets a ring trough with a second sealing ring on the ring trough.

6. An illuminative device in accordance with claim 1, wherein the sleeve of the optical device sets an inside flange on the front inside end for holding the lens.

7. An illuminative device in accordance with claim 1, wherein the sleeve of the optical device sets an inside screw thread on the front inside end for screwing the fastening ring with an outside screw thread to fasten the lens.

8. An illuminative device in accordance with claim 1, wherein the lens is an aspheric convex flat lens.

9. An illuminative device in accordance with claim 1, wherein the emitter is a light emitting diode (LED).

* * * * *